United States Patent [19]

Roman et al.

[11] 4,113,483

[45] Sep. 12, 1978

[54] PHOTOSENSITIVE MATERIAL CONTAINING DI-IODOPROPYL CELLULOSE, PROCESS FOR ITS MANUFACTURE AND THE USE OF THIS MATERIAL

[75] Inventors: Alain Roman, Bossey; Jean-Pierre Sachetto, Saint-Julien en Genevois, both of France; Manfred Wust, Dardagny; Jean Koutroulos, Carouge, both of Switzerland

[73] Assignee: Neste Oy, Finland

[21] Appl. No.: 768,494

[22] Filed: Feb. 14, 1977

[51] Int. Cl.[2] ..... G03G 0/00; G03C 1/00; G03C 5/24

[52] U.S. Cl. ..... 96/1 PC; 96/90 R; 96/87 R; 96/115 R; 96/88; 96/89; 96/48 R; 96/27 E; 536/84; 536/99; 96/1.5

[58] Field of Search ..... 536/84, 99; 96/115 R, 96/88, 89, 87 R, 48 QP, 48 R, 27 R, 27 E, 1.5, 1 PC, 90 R

[56] References Cited

U.S. PATENT DOCUMENTS

| | | | |
|---|---|---|---|
| 3,042,518 | 7/1962 | Wainer | 96/90 R |
| 3,565,628 | 2/1971 | Garland et al. | 96/88 |

FOREIGN PATENT DOCUMENTS

| | | | |
|---|---|---|---|
| 346,806 | 4/1931 | United Kingdom | 536/84 |

OTHER PUBLICATIONS

Chem. Abs., vol. 70, 1969, 48771z.

*Primary Examiner*—Won H. Louie, Jr.
*Attorney, Agent, or Firm*—Steinberg & Blake

[57] ABSTRACT

A photosensitive material is provided in which at least one surface portion of a substrate contains di-iodopropyl cellulose uniformly distributed therethrough. A photosensitive sheet material can be formed totally of di-iodopropyl cellulose or in part by di-iodopropyl cellulose, provided that the surface thereof contains di-iodopropyl cellulose. Upon exposure to electromagnetic radiation, including wave lengths not greater than 0.315 microns, radical iodine is liberated which forms molecular iodine spots to form an image corresponding to the intensity of the irradiation with the electromagnetic radiation. A provision is further made for bringing the surface of the material into contact with a substance which forms a colored compound upon reaction with the iodine.

20 Claims, No Drawings

PHOTOSENSITIVE MATERIAL CONTAINING DI-IODOPROPYL CELLULOSE, PROCESS FOR ITS MANUFACTURE AND THE USE OF THIS MATERIAL

BACKGROUND OF THE INVENTION

Various materials are known for use as photosensitive materials for the recording of an image or the like. Many such materials are dependent upon light of different wave lengths and new materials with different properties are constantly being sought.

SUMMARY OF THE INVENTION

Generally speaking, in accordance with the invention a photosensitive material is provided in which at least the surface of at least one face contains di-iodopropyl cellulose uniformly distributed therethrough. Upon exposure to electromagnetic radiation including wave lengths not greater than 0.315 microns, the intensity of the radiation being modulated according to contours of an image, an image appears in visible form on the surface of the material.

It is accordingly a primary object of the present invention to provide a photosensitive material which can be used for recording an image.

It is another object of the present invention to provide means of producing such photosensitive material.

It is yet a further object of the present invention to provide a photosensitive material which can be used to produce images of different kinds.

It is yet another object of the present invention to provide a method of forming images using the photosensitive material of the present invention.

Other objects and advantages of the present invention will be apparent from a further reading of the specification and of the appending claims.

With the above and other objects in view, the present invention mainly comprises a photosensitive sheet material at least one surface portion of which has di-iodopropyl cellulose distributed therein.

The present invention further comprises the manufacture of such photosensitive sheet material according to one method of which the material consists of paper which is formed by a mixture of paper-making fibers consisting of cellulose and fibers of di-iodopropyl cellulose. Thus, for example, in this embodiment the paper can be formed of 70 to 90% by weight of cellulose fibers and of 10 to 30% by weight of di-iodopropyl cellulose fibers.

According to a further embodiment of the invention the di-iodopropyl cellulose fibers can be at least partly replaced by di-iodopropyl cellulose in particulate or powder form.

It is further possible according to the present invention to provide a sheet material formed solely of fibers of di-iodopropyl cellulose.

Still further it is possible to form the sheet material of a paper or the like consisting of a mixture of allyl cellulose fibers and of di-iodopropyl cellulose fibers.

Numerous other forms of the sheet material are possible, particularly the following:

A sheet material formed of a mixture of cellulose fibers, allyl cellulose fibers and di-iodopropyl cellulose fibers.

A sheet material formed of a mixture of fibers of one or more synthetic material, such as fibers of polyethylene, polypropylene, etc. and fibers of di-iodopropyl cellulose. In this embodiment too, the di-iodopropyl cellulose fibers can be at least partly replaced by di-iodopropyl cellulose in particulate form such as di-iodopropyl cellulose powder.

A sheet material formed of a mixture of cellulose fibers, fibers of one or more synthetic material and di-iodopropyl cellulose fibers. In this case too at least a portion of the di-iodopropyl cellulose fibers can be replaced by powder particles of di-iodopropyl cellulose.

A sheet material formed of a mixture of fibers of one or more synthetic material, of allyl cellulose fibers and of di-iodopropyl cellulose fibers (at least a portion of which can be replaced by particulate di-iodopropyl cellulose). A sheet material formed of a mixture of cellulose fibers, fibers of the synthetic material, allyl cellulose fibers and di-iodopropyl cellulose fibers (which may be at least partly in powder form).

A sheet of di-iodopropyl cellulose film.

A film formed of allyl cellulose with di-iodopropyl cellulose in at least one surface portion.

A film formed of at least one film-forming polymeric material such as polymethyl methacrylate, polyvinyl alcohol, an epoxy resin, a polyester, a phenol resin, or a cellulose polymer, with di-iodopropyl cellulose fibers being dispersed therethrough. In this embodiment too, the di-iodopropyl cellulose fibers can be replaced at least in part by powder particles of di-iodopropyl cellulose.

Any suitable support such as a sheet of paper, cardboard, a film of plastic material, etc. having at least one surface layer formed at least in part by a synthetic or cellulosic high molecular weight binder, such as polyvinyl alcohol, acrylic latex, starch, a cellulose ether or a cellulose ester, said binder having dispersed therethrough particles of di-iodopropyl cellulose.

According to the present invention a sheet of material consisting at least in part of di-iodopropyl cellulose is formed, this sheet material being photosensitive as a result of the di-iodopropyl cellulose.

In accordance with the one method of producing such sheet material, a paper sheet is prepared from a homogeneous mixture of cellulose fibers and di-iodopropyl cellulose fibers. It is possible to produce such sheet material in the manner usual for the manufacture of conventional paper and to use machines normally employed for this purpose for the production of the sheet material of the present invention.

According to one modification of this process it is possible to replace at least a portion of the cellulose fibers with fibers of one or more synthetic material such as fibers of polyethylene, polypropylene, polyamide, etc.

As indicated above, in any of these processes it is possible to modify the same by substituting at least a portion of the di-iodopropyl cellulose fibers by powdered particles of di-iodopropyl cellulose.

On the other hand, it is possible to produce a sheet material solely of di-iodopropyl cellulose fibers, which sheet material can be used according to the present invention as a photosensitive material.

According to a still further method of producing the photosensitive bodies of the invention a paper sheet is prepared from a homogeneous mixture of cellulose fibers and/or fibers of a synthetic material, which mixture also includes allyl cellulose fibers, and at least one face of the sheet is brought into contact with an iodine solution (aqueous or organic) for a period of time sufficient for converting at least a portion of the allyl cellulose fibers into di-iodopropyl cellulose fibers, this resulting from the addition reaction of iodine on the allyl cellulose.

In accordance with yet another embodiment of the invention an allyl cellulose film is prepared and then at least one face of this film is brought into contact with an iodine solution for a period of time sufficient to transform at least a portion of the film, from the surface inward, into di-iodopropyl cellulose.

With respect to the production of the allyl cellulose films, it is possible to operate by any appropriate procedure, for example by the well known technique called "solvent casting", which consists in casting onto a smooth surface formed, for example, by a flat surface or by a roller which is rotated about its axis, of a solution of the material intended for the film formation, the solvent for the solution being volatile so that upon evaporation of the solvent film is formed.

Another process of producing the photosensitive material of the present invention comprises directly forming a film of at least one film-forming polymeric material in which fibers or particulate powder material of di-iodopropyl cellulose are homogeneously dispersed. For carrying out this method it is possible for a powder of the thermoplastic polymer, such as polyethylene, polyvinyl chloride, etc. to be mixed with fibers or a powder of di-iodopropyl cellulose, in such a way as to form a homogeneous dispersion, and to prepare a photosensitive material from this dispersion by proceeding, for example, in accordance with a conventional extrusion process. It is actually possible to make use of any appropriate technique, particularly the technique of "solvent casting" to form such material. In the case of the use of the solvent casting technique, a suspension of di-iodopropyl cellulose, in fiber or powder form, in a solution of the film-forming polymer, is used for the preparation of the film.

It is possible to use, for example, an acrylic or methacrylic polymer or a vinyl polymer, or even an epoxy resin, a polyester, a phenol or epoxy-phenol resin, etc. as the film-forming polymeric material.

The fibers or the powder particles of di-iodopropyl cellulose can be obtained by the addition reaction of iodine on allyl cellulose, this reaction preferably taking place at ambient temperature. The allyl cellulose used as the initial material for this method preferably has a degree of substitution of at least 0.05 and up to 3. It is preferred that the degree of substitution of the allyl cellulose be between 0.05 and 0.65, which results in a water soluble product, or an allyl cellulose having a degree of substitution between 0.7 and 1.5, which product in soluble in certain organic solvents such as N-methyl pyrrolidone and dimethyl sulphoxide.

According to one method of preparing di-iodopropyl cellulose fibers, the addition reaction of the iodine onto the allyl cellulose can be effected by dispersing allyl cellulose in fiber form in a solution of iodine in an appropriate solvent such as water or an organic solvent such a methanol, ethanol, carbon tetrachloride, chloroform, etc., and keeping the fibers in the solution for a period of time sufficient to obtain the desired degree of the addition reaction. It is possible in this manner to produce di-iodopropyl cellulose in the form of white fibers.

For the preparation of di-iodopropyl cellulose powder, it is possible to prepare a solution of allyl cellulose in an appropriate solvent and then to dissolve the iodine in the solution or to mix the solution with a solution of iodine. In this way the di-iodopropyl cellulose is obtained in the form of a precipitate.

The latter can be separated from the liquid phase and dried, resulting in a while di-iodopropyl cellulose powder.

The photosensitive material of the present invention is used for recording an image by exposing the same to electromagnetic radiation of which at least a portion of the spectrum comprises wave lengths not greater than 0.315 microns, the intensity of the radiation being modulated according to the contours of the image for a period of time sufficient to cause the image to appear in a visible form on the surface of the material.

As source of the electromagnetic radiation it is possible to use, for example, a mercury vapor lamp of which the emission is mainly formed by the ultraviolet portion of the spectrum of the electromagnetic radiations. For modulating the intensity of the irradiation according to the contours of the image, it is possible, for example, to use a screen or filter for electromagnetic radiations, the surface of the screen or filter having portions which absorb in a different manner the wave length radiations which are lower than 0.315 microns. More particularly, it is possible to use as a screen for this purpose, a photographic negative of the conventional type, or to form the image by projection by means of a suitable optical system.

With respect to the time of irradiation, this of course depends on the iodine content in the surface portion of the photosensitive material and on the degree of contrast desired. The time is preferably between a few tenths of a second and a few minutes.

The image appears in the form of stains which are yellow to brown color, corresponding to the irradiated parts of the surface of the material. These stains or spots are distinguished by color contrast by those parts of the material surface which were not irradiated, these parts maintaining their original white to whitish coloring. The use of a screen or a filter, of which the surface has areas in which the transmission of the electromagnetic irradiations has an intermediate value between the value 0% and the value 100%, it is possible to form an image having stains or spots, in which the intensity can vary continuously between the maximum intensity and an intensity which can be scarcely detected visually.

The formation of colored stains or spots can be attributed to the liberation of radical iodine from the di-iodopropyl cellulose, under the effect of the irradiation by the wave lengths not greater than 0.315 microns, and to the recombination of these radicals in the form of molecular iodine which is absorbed on the cellulose fiber and which is yellow in color.

At the same time that radical iodine forms, there is also formed cellulosic macroradicals.

It is possible to modify the color of the image and/or to increase its contrast by effecting a chemical development resulting from the formation of colored compounds between the molecular iodine and one or more suitable substances. Thus, for example, it is possible to treat the surface of the photosensitive material, before or after the exposure to the electromagnetic radiations, with a solution of amylose (starch paste), or $\alpha$-naphthaflavone. Under these conditions an intense blue image is obtained by the formation of a colored complex of the iodine. When necessary it is possible to stabilize the thus-formed complex by means of an appropriate substance.

The molecular iodine, which is an oxidizing agent, can be used in a Redox system in which a change in color is produced. Thus, for example, it is possible to use the ferro-ferricyanide system (potassium ferrocyanide (yellow) + $I_2$ - potassium ferricyanide (red) + 2I).

The color can also be modified and the contrast of the image can be increased by effecting a photochemical development in which a dye is formed, during the irradiation, by the reaction between radical iodine and an appropriate organic compound, such as an aromatic compound. Aromatic amines are preferred for this purpose since these compounds permit the formation of a stable dye quickly upon ultraviolet irradiation which results in a reaction thereof with radical iodine.

It is also well known that certain aromatic amines are both photosensitive and sensitive to oxidation, by forming a colored species. However, in the absence of radical iodine, such reaction is slow and requires several hours to several days for obtaining a stable color. When carrying out the photochemical development according to the present invention, the irradiation time which is necessary for obtaining an image of sufficient contrast is on the order of one-half to a few seconds, depending upon the power of the source of radiation which is used. Under the same conditions, an exposed aromatic amine by itself assumes a much weaker coloring with insufficient contrast in the image.

It is possible to use as an amine which forms a dye in the presence of the iodine under irradiation, for example, a primary aromatic amine such as: aniline, benzidine, o-dianisidine, aminophenol, 1,8-diamino naphthalene, o-toluidine, o-phenylene diamine, M-phenylene diamine, p-phenylene diamine, 4,5-dimethyl-1,2-phenylene diamine, N,N-dimethyl-1,4-phenylene diamine, tetramethyl diamino-4,4-diphenyl methane.

It is also possible to employ a secondary aromatic amine, such as: diphenylamine, dibenzylamine; or even a tertiary aromatic amine, such as triphenylamine.

Thus, it is possible to employ aromatic diamines or monoamines, in which the amino group is carried by a side chain directly connected to the aromatic nucleus, this latter being a benzene, naphthene or anthracene ring.

The incorporation of the photochemical developing agent can be carried out by impreganting the photosensitive material with an aqueous or organic solution of this agent, in a concentration of, for example, between 0.01 and 5% by weight.

The irradiation is preferably effected after elimination of the impregnation solvent. With the ending of the irradiatkon, a well contrasted image is obtained, the color of the image varying according to the photochemical developing agent which is used.

Table 1 indicates by way of example certain primary, secondary or tertiary aromatic amines, which can be used, and also the corresponding colors which are obtained, after irradiation.

TABLE 1

| Amine | Color after UV irradiation |
|---|---|
| aniline | light brown |
| benzidine | brown |
| o-dianisidine | reddish-brown |
| aminophehyl | light brown |
| 1,8-diamino maphthalene | dark brown |
| o-toluidine | light brown |
| p-phenylene diamine | violet-brown |
| 4,5-dimethyl-1,2-phenylene diamine | brown |
| tetramethyl-diamino-4,4'-diphenyl methane | blue |

TABLE 1-continued

| Amine | Color after UV irradiation |
|---|---|
| diphenylamine | light brown |

In the case where an aromatic amine is used as a photochemical developing agent, it may be expedient to eliminate the amine excess not combined with the iodine, after formation of the image, in order to avoid a spontaneous parasitic coloring of the material in the presence of air and under the action of light. Actually, the majority of the aromatic amines to be considered as photochemical developing agent are able spontaneously to form colored substances by simple exposure to air and to light.

For this purpose, the photosensitive material, after photochemical development, can be subjected to neutralizing treatment to neutralize the amines by immersing the material in a bath formed of a dilute aqueous solution containing 0.05 to 3% by weight of a mineral or organic acid. In this way, a salt of the amine is formed, which passes into the aqueous solution.

As acid, it is for example possible to use a mineral acid, such as hydrochloric acid, sulfuric acid, nitric acid or boric acid, etc., or an organic acid such as formic acid, oxalic acid, glycolic acid, tartaric acid, cinnamic acid, etc.

For further increasing the contrast of the image, in the case where photochemical development is carried out, it is possible to use a strong oxidizing agent, such as a persulphate (for example, an alkali persulphate, such as $K_2S_2O_8$; $Na_2S_2O_8$; $(NH_4)_2S_2O_8$, etc.) or hydrogen peroxide. For this purpose, the oxidizing agent can be incorporated into the photosensitive material at the same time as the photochemical developing agent or the oxidizing agent can be added to the acid neutralizing bath previously referred to. In this latter case, the concentration of the oxidizing agent in the neutralizing bath is for example between 0.05 and 3% by weight.

After photochemical development and possible neutralization of the excess of developing agent, the photosensitive material is washed with water and then dried. In this way, a highly contrasted colored image is obtained, which is insoluble in water or organic solvents. The nonirradiated part of the material is free from any colored substance and it retains its original photosensitivity. Consequently, it is possible for several images of like color or of different colors to be formed in succession on the same material.

In the case where chemical or photochemical development is not carried out, the iodine stains formed at the time of irradiation can be eliminated in appropriate manner, for example, by being dissolved in a suitable solvent, such as methanol. The corresponding image is thus caused to disappear and it is then possible to carry out a new exposure of the surface of the material so as to form a new image. Such cycle of removal and formation of images can be repeated about ten times, without any appreciable decrease in the contrast of the image.

It is also possible to transfer the image onto the surface of another image support (receiver support), by contact between the surface of the material carrying the image and the surface of the receiver support. As receiver support, it is for example possible to use a sheet of paper, the surface of which includes a white colorless substance (for example, starch paste) suitable for forming a colored substance by reaction with iodine.

It is possible to take advantage of the electrostatic contrast which results from the difference in electrical conductivity between the irradiated and non-irradiated parts of the material, which difference in conductivity results from the liberation of iodine in the irradiated parts (resistivity of the order of $1.10^{11}$ ohm.cm), whereas the non-irradiated parts maintain their original resistivity (about $2.10^{12}$ ohm.cm), in order to cause the image to appear by a process of electrophotographic development (dry or wet electrostatic development). One such process which is known per se consists in applying a uniform electrostatic charge to the surface of the material, then in bringing the face of the material opposite to that which has received this charge into contact with a substrate having a high electrical conductivity, for example, a metallic sheet, this substrate being brought to a zero potential, so as to form on the surface of the material a latent image modulated in the form of differences in electrostatic charge densities, and finally in materializing the latent image means of "toner" grains (fusible colored powder which is fixed by electrostatic attraction onto the surface of the material and which is then fused for making the image permanent).

The detailed description of such an electrophotographic development process appears for example in the following work:

Electrophotography, by R. M. Schaffert, The Focal Press, London and New York (1965).

DESCRIPTION OF PREFERRED EMBODIMENTS

The invention is further illustrated by the following examples. The scope of the invention is not, however, meant to be limited to the specific details of the examples:

EXAMPLE 1

A. Preparation of di-iodopropyl cellulose fibers

One part by weight of allyl cellulose fibers, having a degree of substitution of 0.33, is suspended in a volume of ethanol corresponding to 10 milliliters per gram of allyl cellulose, and half a part, by weight, of iodine is dissolved in the suspension which is thus obtained.

The reaction medium thus formed is kept for 3 hours at ambient temperature (20° C.), with a sufficient degree of agitation for maintaining the fibers is suspension. The fibers are then separated from the liquid, washed with ethanol to eliminate any unfixed iodine, and finally dried, by being heated with air at 60° C. All of these operations, from the moment when the iodine is introduced into the suspension, are carried out in a chamber illuminated by a light source, of which the emission spectrum does not comprise wave lengths lower than 0.3 micron.

A fibrous product is obtained which is white in color, having a content of 10.87% by weight of chemically fixed iodine.

B. Preparation of the photosensitive material

Using a machine of the type which is usual for the manufacture of paper, a paper sheet is prepared which has a thickness of 50 microns, using exclusively as initial material the fibers of di-iodopropyl cellulose obtained in the manner indicated above. This preparation is also carried out in a chamber illuminated with a light source, the emission spectrum of which does not comprise any radiation with a wave length lower than 0.316 micron.

There is thus obtained a white paper sheet having an appearance identical to that of normal cellulosic paper. This sheet is completely insensitive to heating, even prolonged heating, up to a temperature not exceeding 150° C., but it quickly becomes yellow (in a few seconds) when it is exposed to solar radiation. On the other hand, it maintains its original white color indefinitely if it is stored free from electromagnetic radiations with a wave length lower than or equal to 0.315 micron.

C. Use of the photosensitive material for recording an image

A piece of the photosensitive paper sheet obtained in the manner indicated above is exposed for 2 minutes to an irradiation by the radiation emitted by a low-pressure mercury vapor lamp (Philips lamp, type HTQ 7, having a power of 2000 watts), positioned at 15 cm from the surface of the sheet, through a photographic negative, the support of which is a film with a base of cellulose.

The formation of an image, appearing by contrast of yellow stains, on the surface of the sheet of photosensitive paper is thus obtained, such stains corresponding to the exposed parts, on a white background, having the original shade or tint of the opaque sheet of the negative.

EXAMPLE 2

The same procedure is carried out as in Example 1, but using, as initial material for the manufacture of the photosensitive paper, a mixture of 77% by weight of untreated cellulose fibers as used in paper-making and 23% by weight of di-iodopropyl cellulose fibers.

The photosensitive paper thus obtained has a white color corresponding to an optical density of 0.10 ( a value identical with that of a normal cellulose paper).

The optical density of the exposed parts of the image varies as a function of the irradiation time, as indicated in the following table:

| Irradiation time (minutes): | Optical density: |
|---|---|
| 1 | 0.12 |
| 3 | 0.13 |
| 5 | 0.14 |
| 7 | 0.15 |
| 10 | 0.16 |

EXAMPLE 3

The same procedure is carried out as in Example 1, but using di-iodopropyl cellulose fibers prepared from allyl cellulose fibers having a degree of substitution of 0.63 instead of 0.33. These di-iodopropyl cellulose fibers have a content of 15.33% by weight of chemically fixed iodine.

The appearance and the properties of the photosensitive paper are identical with those of the photosensitive material of Example 1 and the same result as in Example 1 is obtained, when this paper is used for recording an image.

Identical with Example 1, but using di-iodopropyl cellulose fibers prepared from allyl cellulose fibers having a degree of substitution of 1.5. The content of chemically fixed iodine in these di-iodopropyl cellulose fibers is 19.5% by weight.

A photosensitive paper is also obtained, which in appearance and properties is identical to the photosensitive material of Example 1.

EXAMPLE 5

Multiple use of the photosensitive material of Example 2

The image formed on the photosensitive material of Example 2 is obliterated by the piece of this material bearing the image being immersed for 10 seconds in a methanol bath. This piece or section of photosensitive material is dried. After drying, this material appears perfactly free from any trace of the image and it has the same uniform white shade or tint as before the formation of this image.

The recording of an image in the same manner as in part C of Example 1 is then repeated, with an identical result.

5 obliteration and recording cycles for the image are carried out, without any appreciable decrease in the contrast of the image being observed.

Example 6

Modification of the coloring and the contrast of the image by formation of a colored complex Using an inking roller, a 0.5% by weight aqueous solution of starch paste is applied to a piece or section of the photosensitive material according to Example 2, carrying an image formed in the manner indicated in part C of said example.

Those parts of this image which were initially yellow in color immediately assume a blue coloration.

EXAMPLE 7

The same procedure is carried out as in Example 6, but replacing the aqueous solution of starch paste by a 0.5% by weight solution of starch paste in a mixture of equal volumes of water and ethanol.

Those parts of the image which were initially yellow in color immediately assume a brown coloring, the stability of which is very high (the image thus formed is unchanged after the material has been stored for 1 month).

EXAMPLE 8

Improvement in the stability to daylight of the image obtained according to Example 6

The procedure is as in Example 6, but before forming the image, the photosensitive paper is impregnated with an aqueous solution of potassium oxalate and then it is dried.

The same result as in Example 6 is obtained, but with a greater stability of the image as regards the action of daylight. This improvement in the stability of the image *p* probably results from the formation of potassium iodide by reaction between the iodine and the potassium oxalate at the time of irradiating the material.

EXAMPLE 9

Formation of a colored complex by means of a substance introduced into the photosensitive material before the image is recorded The procedure is as in Example 2, but, before exposing the photosensitive material to the irradiation, it is impregnated with a 1.6% by weight solution of diphenylamine in ethanol, whereafter the material is dried.

An image is thereby obtained, which is formed of stains which are brown in color, corresponding to the exposed parts, forming a contrast with the unexposed parts, which maintain the original white tint or shade of the photosensitive paper.

EXAMPLE 10

The same procedure is carried out as in Example 9, but using an impregnation solution which is formed of 1.5% by weight of 1,4-phenylene diamine in ethanol. The material is dried at 80° C. for eliminating the alcohol and is then subjected to irradiation for 2 minutes. A dark violet-brown image is obtained.

The paper thus provided with an image is immediately washed in an aqueous solution containing 1% of formic acid and 0.2% ammonium persulphate ($(NH_4)_2S_2O_8$). The color of the image changes from violet-brown to brown. The specimen is then washed in water and the paper is then dried. Finally, a stable, very well contrasted image on a white background is obtained. The optical densities of the non-image and image zones are respectively: 0.20 and 0.58. No development of the optical density, particularly of the non-image zones, is observed over a period longer than 4 months.

It is established that the paper bearing the image as thus obtained does not have any odor, particularly of aromatic products. The absence of free 1,4-phenylene diamine is also confirmed. In particular, the irradiation for a second time, in a non-image zone, leads to the formation of a yellow iodine image.

On the other hand, if the material is kept after irradiation without it being subjected to the acid washing treatment, a rapid blackening of the non-image zones is observed (in a few hours), whereas the image zones show the original brownish-violet color.

EXAMPLE 11

The procedure is as in Example 10. The washing solution is formed of 1% of formic acid and 1% of ammonium persulphate in water. The optical densities of the non-image and image zones are respectively 0.17 and 0.69. No development of these optical densities is observed over a period of 4 months.

EXAMPLE 12

The procedure is as in Example 10. The specimen is irradiated for 15 seconds, instead of for 2 minutes. The irradiated specimen is treated in a bath which is formed of 1% glycolic acid, 3% of hydrogen peroxide, 0.5% potassium persulphate. The respective densities of the non-image and image zones are 0.23 and 0.44, stable over a period of 4 months.

EXAMPLE 13

The procedure is as in Example 10. The impregnating solution for the photosensitive paper is formed of 1.5% of 1,4-phenylene diamine and 0.2% of 1,3-phenylene diamine dihydrochloride in ethanol. The washing is effected in a solution formed of 1% hydrochloric acid and 1% sodium persulphate in water. The respective optical densities of the non-image and image zones are 0.20 and 0.62, stable over a period of 4 months.

EXAMPLE 14

The procedure is as in Example 13. The washing solution is formed of 1% nitric acid and 1% ammonium persulphate in water. The optical densities are respectively 0.18 and 0.74, stable over a period of 4 months.

EXAMPLE 15

The procedure is as described in Example 14. The washing solution is formed of 1% nitric acid and 1% ammonium persulphate in water. The optical densities are respectively 0.18 and 0.74, stable over a period of 4 months.

EXAMPLE 15

The procedure is as described in Example 14. The washing solution is formed of 1% HCl and 1% ammonium persulphate in water. The optical densities of the non-image and image zones are respectively 0.13 and 0.45, stable over a period of 4 months.

EXAMPLE 16

The procedure is as in Example 1, but using, as initial material in the manufacture of the photosensitive paper, a mixture of 90% by weight of virgin paper-making cellulose fibers and 10% by weight of di-iodopropyl cellulose fibers, obtained from wood cellulose and itself having an iodine content of 17.8% by weight. The specimens are irradiated at a distance of 15 cm beneath an ultra-violet mercury vapor tube with a linear power of 200 watts/cm.

The photosensitive paper is first impregnated, by the procedure of Example 10, with a solution formed of 0.8% 1,4-phenylene diamine and 0.2% 1,3-phenylene diamine hydrochloride in ethanol. The papers bearing an image are washed in a solution formed of 1.5% formic acid and 1% ammonium persulphate in water. The following results are obtained, as a function of the irradiation time:

| Irradiation time | Optical density image | Optical density background |
|---|---|---|
| 5 seconds | 0.54 | 0.16 |
| 3 | 0.48 | 0.15 |
| 1.5 | 0.32 | 0.14 |
| 0.8 | 0.26 | 0.16 |
| 0.3 | | |

No development or change in the optical densities is observed over a period of 4 months.

EXAMPLE 17

A. Preparation of an allyl cellulose film

A 5% by weight aqueous solution of allyl cellulose, having a degree of substitution of 0.4, is cast onto a flat substrate with a smooth surface. The water is evaporated under a pressure of 20 mm.Hg. at ambient temperature. In this way, a transparent film of allyl cellulose is obtained with a thickness of 40 microns.

B. Preparation of the photosensitive material

The allyl cellulose film obtained as indicated above is kept immersed for 24 hours in a solution of iodine in ethanol (containing 10 g of iodine per liter of ethanol), after which the film is washed with ethanol until it becomes colorless, and finally the film is dried in a stream of dry air at 50° C.

All the operations described in part B of this example are carried out in a chamber illuminated with light free from radiation of a wave length lower than 0.4 micron.

In this way, a film of di-iodopropyl cellulose is obtained which has a content of 13% by weight of chemically fixed iodine.

C. Use of the photosensitive material for recording an image:

The procedure indicated in part C of Example 1 is followed.

In this way, an image is obtained which is formed of yellow spots or stains corresponding to the exposed parts, forming a contrast with the unexposed parts of the material, which remain colorless.

The optical density of these unexplsed parts is 0.22, while that of the exposed parts varies, as a function of the exposure time, as indicated in the following table:

| Irradiation time (minutes) | Optical density: |
|---|---|
| 1 | 0.46 |
| 2 | 0.64 |
| 4 | 0.74 |
| 6 | 0.80 |

EXAMPLE 18

The procedure according to Example 11 is followed, but using an allyl cellulose film having a degree of substitution of 1.5, which is prepared from a 5% by weight solution in N-methyl pyrrolidone, by effecting the evaporation of the solvent under a pressure of 20 mm.Hg., at 80° C.

The di-iodopropyl cellulose film has a content of 17.6% by weight of chemically fixed iodine.

After exposure of the material, there is also obtained an image formed of yellow stains, the optical density of the unexposed parts being 0.2, whereas the optical density of the exposed parts varies, as a function of the exposure time, as indicated in the following table:

| Irradiation time (minutes) | Optical density: |
|---|---|
| 1 | 0.32 |
| 2 | 0.38 |
| 4 | 0.36 |
| 6 | 0.51 |
| 10 | 0.60 |

EXAMPLE 19

Multiple use of the photosensitive material of Example 17

The procedure described in Example 5 is followed, but using the photosensitive material of Example 17. The result obtained is similar to that which is described in Example 5.

EXAMPLE 20

Electrophotographic development of the image formed on the photosensitive material of Example 18

After exposing the photosensitive material of Example 18 for 10 minutes to irradiation by ultra-violet radiation, under conditions identical to those which are described in part C of Example 1, the surface of this material is exposed to a corona discharge at a voltage of 600 volts, applied uniformly to the whole of the surface, the face of the material opposite to that which receives the corona discharge being applied to a grounded aluminum sheet, or plate.

As a result, an electrostatic latent image, of which the electrostatic contrast is equal to 15, is formed between the exposed parts and the unexposed parts. This contrast results from the fact that the resistivity of the exposed parts is $1.2 \cdot 10^{11}$ ohm/cm, whereas that of the unexposed parts is $18 \cdot 10^{11}$ ohm/cm).

Finally, the electrostatic latent image is developed by the process known as the "cascade" process, using a dry "toner", charged beforehand, and the image is fixed by infred-red heating for a time sufficient to melt or fuse the toner.

While the invention has been illustrated with specific examples, it is apparent that variations and modifications of the invention can be made.

What is claimed is:

1. Photosensitive material comprising a substrate at least one surface portion of which contains uniformly distributed di-iodopropyl cellulose.

2. Photosensitive material according to claim 1 in which said substrate is a sheet formed of cellulose fibers and di-iodopropyl cellulose fibers.

3. Photosensitive material according to claim 1 in which said substrate is formed of a sheet of cellulose fibers with powdered di-iodopropyl cellulose distributed therein.

4. Photosensitive material according to claim 1 wherein said substrate is a sheet material formed solely of di-iodopropyl cellulose fibers.

5. Photosensitive material according to claim 1 in which said substrate is a sheet formed of cellulose fibers, fibers of at least one synthetic fiber-forming material and di-iodopropyl cellulose fibers.

6. Photosensitive material according to claim 1 in which said substrate is a sheet material consisiting of a film of di-iodopropyl cellulose.

7. Photosensitive material according to claim 1 in which said substrate is a sheet consisting of a film of at least one film-forming polymeric material and having di-iodopropyl cellulose dispersed therein.

8. Method of producing the photosensitive material of claim 1 which comprises forming a film of allyl cellulose and contacting at least one face of the thus formed film with an iodine solution for a time sufficient to convert at least the surface of said film into di-iodopropyl cellulose.

9. Photosensitive material according to claim 1 and including at the surface of said substrate a compound which reacts with iodine to form a colored complex so that said photosensitive material can be used for the formation of colored images.

10. Photosensitive material according to claim 1 wherein said substrate contains in its surface a compound which reacts in a Redox system with iodine to cause a change in color.

11. Photosensitive material according to claim 1 and including in the surface of said substrate an aromatic amine which forms a dye with iodine.

12. Method of forming an image on the photosensitive material of claim 1 which comprises exposing the surface of said photosensitive material to electromagnetic radiation in which at least a portion of the spectrum includes wave lengths not greater than 0.317 micron, the intensity of the radiation being modulated according to the contours of the selected image, for a period of time sufficient to cause the appearance of said image in visible form on the surface of said material.

13. Method according to claim 12 and wherein a compound which reacts with molecular iodine to form a colored compound is brought into contact with the surface of said photosensitive material, whereby the image is formed as a colored image.

14. Method according to claim 13 wherein said compound reacts chemically with molecular iodine to form the colored compound.

15. Method according to claim 13 wherein said compound reacts photochemically with radical iodine to form a colored compound.

16. Method according to claim 13 wherein said compound is an aromatic amine which is oxidized by molecular iodine to form a colored compound.

17. Method according to claim 15 wherein after photochemical development of the colored compound said surface is subjected to neutralization treatment to remove the excess of said compound not combined with the iodine.

18. Method according to claim 15 wherein said photosensitive material is subjected to treatment with an oxidizing agent to increase the contrast of the formed image.

19. Method according to claim 12 wherein the image on the photosensitive material is subsequently transferred onto the surface of a receptive image support, the surface of which includes a substance which reacts with iodine to form a colored substance.

20. Method according to claim 12 wherein the irradiated photosensitive material is subjected to electrostatic development by applying an electrostic charge to a surface thereof, contacting the opposite surface thereof with a substrate of high electrical conductivity so as to form a latent image on the surface of said material, and materializing said latent image by means of a toner.

* * * * *